US012416159B2

(12) United States Patent
Robida

(10) Patent No.: US 12,416,159 B2
(45) **Date of Patent: *Sep. 16, 2025**

(54) OFF-RIDGE ROOF VENTILATION DEVICE

(71) Applicant: MARCO INDUSTRIES INC., Tulsa, OK (US)

(72) Inventor: Albert Robida, Apopka, FL (US)

(73) Assignee: MARCO INDUSTRIES INC., Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/126,050

(22) Filed: Mar. 24, 2023

(65) Prior Publication Data

US 2023/0228092 A1 Jul. 20, 2023

Related U.S. Application Data

(63) Continuation of application No. 16/709,153, filed on Dec. 10, 2019, now Pat. No. 11,739,532.

(Continued)

(51) Int. Cl.
*E04D 13/17* (2006.01)
*F24F 7/02* (2006.01)

(52) U.S. Cl.
CPC ..... *E04D 13/174* (2013.01); *F24F 7/02* (2013.01)

(58) Field of Classification Search
CPC . E04D 13/174; E04D 2001/309; E04D 13/17; E04D 1/30; F24F 7/02; F24F 2221/52

(Continued)

(56) References Cited

U.S. PATENT DOCUMENTS 429,937 A 6/1890 Mitchell
2,318,820 A 5/1943 Voigt et al.

(Continued)

FOREIGN PATENT DOCUMENTS

JP 07109797 A 4/1995
JP 07157960 A 6/1995

(Continued)

OTHER PUBLICATIONS

Korean Intellectual Property Office, "PCT International Search Report and Written Opinion," mailed Jul. 23, 2014, for PCT Application No. PCT/US2014/027897, 12 pages.

(Continued)

*Primary Examiner* — Steven B McAllister
*Assistant Examiner* — Charles R Brawner
(74) *Attorney, Agent, or Firm* — Dorsey & Whitney LLP

(57) ABSTRACT

An off-ridge roof ventilation device for placing on an opening of a roof deck. The ventilation device comprises an elongated main hood with a curved shape. The right end of the main hood is closed by a right-side panel, and the left end of the main hood is closed by a left-side panel. The main hood comprises a perforated top face and a venting opening on a bottom face. A throat panel is placed on the bottom face of the main hood in a manner to reduce the venting opening. A perforated interior panel is placed between the top face of the main hood and the throat panel to eliminate wind driven rain and/or snow even in high wind situations. The perforations are preferably designed as mini-louvers, wherein the mini-louvers of the main hood and the mini-louvers of the throat panel comprise the same shape and count the same number.

20 Claims, 6 Drawing Sheets

Related U.S. Application Data

(60) Provisional application No. 62/864,761, filed on Jun. 21, 2019.

(58) Field of Classification Search
USPC ..... 454/365
See application file for complete search history.

(56) References Cited

U.S. PATENT DOCUMENTS 2,470,201 A * 5/1949 Werner ..... F24F 7/02 454/275
2,490,220 A * 12/1949 Freeland ..... E04D 13/17 454/366
3,492,192 A 1/1970 Bullard
3,884,009 A 5/1975 Frohlich et al.
3,949,657 A 4/1976 Sells
4,024,685 A 5/1977 Aarons
4,189,886 A 2/1980 Fohlich et al.
4,280,399 A 7/1981 Cunning
4,325,290 A 4/1982 Wolfert
4,545,291 A * 10/1985 Kutsch ..... E04D 13/174 454/365
4,545,292 A 10/1985 Inokawa et al.
4,558,637 A 12/1985 Mason
4,570,396 A 2/1986 Struben
4,598,505 A 7/1986 McGown
4,754,589 A 7/1988 Leth
4,843,953 A 7/1989 Sells
4,876,950 A 10/1989 Rudeen
4,924,761 A 5/1990 MacLeod et al.
4,957,037 A 9/1990 Tubbesing et al.
4,995,308 A 2/1991 Waggoner
5,002,816 A 3/1991 Hofmann et al.
5,009,149 A 4/1991 MacLeod et al.
5,022,203 A 6/1991 Boyd
5,050,489 A * 9/1991 Mankowski ..... E04D 13/17 454/366
5,060,431 A 10/1991 MacLeod et al.
5,092,225 A 3/1992 Sells
5,095,810 A 3/1992 Robinson
5,122,095 A 6/1992 Wolfert
5,167,579 A 12/1992 Rotter
5,174,076 A 12/1992 Schiedegger et al.
5,288,269 A 2/1994 Hansen
5,304,095 A 4/1994 Morris
5,326,318 A 7/1994 Rotter
5,328,407 A 7/1994 Sells
5,331,783 A 7/1994 Kasner et al.
5,332,393 A 7/1994 Godl
5,352,154 A 10/1994 Rotter et al.
5,353,154 A 10/1994 Lutz et al.
5,425,672 A 6/1995 Rotter
5,427,571 A 6/1995 Sells
5,439,417 A 8/1995 Sells
5,458,538 A 10/1995 MacLeod et al.
5,473,847 A 12/1995 Crookston
5,542,882 A 8/1996 Sells
5,561,953 A 10/1996 Rotter
5,603,657 A 2/1997 Sells
5,803,805 A 9/1998 Sells
5,816,014 A 10/1998 Tzeng et al.
5,826,383 A 10/1998 Garrison
5,867,956 A 2/1999 Gregory et al.
5,921,863 A 7/1999 Sells
5,924,925 A 7/1999 Nystrom
5,947,817 A 9/1999 Morris et al.
6,077,159 A 6/2000 Clayton
6,079,166 A 6/2000 Mason et al.
6,125,602 A 10/2000 Freiborg et al.
6,149,517 A 11/2000 Hansen
6,267,668 B1 7/2001 Morris
6,298,613 B1 10/2001 Coulton et al.
6,308,472 B1 10/2001 Coulton et al.
6,418,678 B2 7/2002 Rotter
6,450,882 B1 9/2002 Morris et al.
6,458,029 B2 10/2002 Morris
6,491,581 B1 12/2002 Mankowski
6,599,184 B2 7/2003 Morris
6,647,675 B1 11/2003 Castellanos
6,662,510 B2 12/2003 Rotter
6,773,342 B2 8/2004 Rotter
6,780,099 B1 8/2004 Harper
6,944,997 B2 9/2005 Verkamp
7,594,363 B2 9/2009 Polumbus et al.
8,024,897 B2 9/2011 Polumbus et al.
8,083,576 B2 12/2011 Rotter
8,276,331 B2 10/2012 Polumbus et al.
8,302,352 B2 11/2012 Bahn et al.
8,790,167 B2 7/2014 Holland et al.
9,151,059 B2 10/2015 Pavlansky et al.
10,590,654 B2 3/2020 Polumbus et al.
11,739,532 B1 * 8/2023 Robida ..... E04D 13/17 454/365
2002/0032000 A1 3/2002 Lawless, III et al.
2002/0194799 A1 12/2002 Sharp et al.
2003/0022618 A1 1/2003 Miller
2003/0051419 A1 3/2003 Suzuki
2003/0077999 A1 4/2003 Mankowski
2004/0137185 A1 7/2004 Sieber et al.
2005/0106360 A1 5/2005 Johnston et al.
2005/0202779 A1 9/2005 Smith
2005/0233691 A1 * 10/2005 Horton ..... E04D 13/17 454/366
2005/0241248 A1 11/2005 Ridenour
2006/0121845 A1 6/2006 Sells
2007/0072539 A1 3/2007 Sells
2007/0093197 A1 4/2007 Shah
2009/0113823 A1 * 5/2009 Osborne ..... E04D 13/17 454/367
2009/0298370 A1 12/2009 Rock
2016/0138270 A1 5/2016 Rotter
2017/0146253 A1 * 5/2017 Mantyla ..... F24F 7/02
2021/0238858 A1 8/2021 Polumbus et al.
2023/0243528 A1 8/2023 Vallery et al.
2024/0003560 A1 1/2024 Allaster et al.
2024/0175588 A1 5/2024 Harris et al.
2024/0183549 A1 6/2024 Harris et al.
2024/0183550 A1 6/2024 Vallery et al.

FOREIGN PATENT DOCUMENTS

WO 95/21975 A1 8/1995
WO 97/32940 9/1997
WO 02092930 A1 11/2002
WO 2014143787 A1 9/2014

OTHER PUBLICATIONS

Canadian Intellectual Property Office, "Third Office Action," mailed Jan. 27, 2015, for Canadian Patent Application No. 2,718,316, 10 pages.
Canadian Intellectual Property Office, "First Office Action," mailed Jun. 12, 2012, for Canadian Application No. 2,718,316, 4 pages.
Canadian Intellectual Property Office, "Second Office Action," mailed Mar. 21, 2013, for Canadian Application No. 2,718,316, 5 pages.
European Patent Office, "Communication pursuant to Rules 70(2) and 70a(2) EPC," mailed Jul. 11, 2013, for European Application No. 11748245.5, 8 pages.
European Patent Office, "Supplementary European Search Report," mailed Jun. 24, 2013, for European Application No. 11748245.5, 8 pages.
European Patent Office, "European Search Report," mailed Nov. 11, 2024, for European Application No. 24185162.5, 11 pages.

* cited by examiner

OFF-RIDGE ROOF VENTILATION DEVICE

CROSS REFERENCE TO RELATED APPLICATIONS

This application is a continuation of U.S. Non-Provisional patent application Ser. No. 16/709,153, filed on Dec. 10, 2019, which claims the benefit of U.S. Provisional Patent Application Ser. No. 62/864,761, filed on Jun. 21, 2019, which are incorporated by reference herein in their entirety.

FIELD OF THE INVENTION

The present invention relates generally to ventilation devices, and more particularly, to an off-ridge roof ventilation device for placing on an opening of a roof deck.

BACKGROUND OF THE INVENTION

Ventilation is the intentional circulation of outdoor and indoor air into and out of enclosed spaces, to dilute and displace indoor pollutants and increase thermal comfort and dehumidification.

Natural ventilation is the intentional passive circulation of outdoor and indoor air into and out of an enclosed space, such as an inside of a building. The passive circulation occurs by air flowing from the outside into the inside of the building and vice versa through planned openings of a building without moving parts. Natural ventilation relies on diffusion, wind pressure, or the stack effect. The internal heat of a building gains by the heat from people inside the building, resulting in a temperature difference between the interior and exterior of the building. The temperature difference creates a pressure difference between the indoor and outdoor space of the building making the air flow from the outdoor space to the indoor space of the building and vice versa.

A roof is the top covering of a building, supported by the walls of the building. The roof protects the interior of the building against rain, snow, sunlight, extreme temperatures, and wind. Roofs are normally either flat or pitched. The pitch refers to the steepness or slope of the roof. Generally, pitched roofs are configured to redirect or prevent accumulation of water and/or snow. Thus, the pitch is typically greater in areas of high rain and/or snowfall.

State of the art ventilation devices are usually mounted on a roof and have a low profile to minimize damage from high winds. In case of a pitched roof, the ventilation device is often placed away from a ridge of the roof to minimize damage from high winds. Such ventilation devices are known as off-ridge roof ventilation devices.

An off-ridge roof ventilation device is usually positioned over an opening in the roof sheathing leading to an attic or other space of the building. The opening of the roof deck is cut from the roof sheathing, wherein the location of the opening of the roof deck is usually at least 12" off the lower roof edge. The off-ridge roof ventilation device is normally configured to cover the opening of the roof deck completely and seal the opening of the roof deck without blocking airflow.

State of the art off-ridge roof ventilation devices usually comprise a hood with a front opening to allow circulation of outdoor and indoor air through an opening in the roof deck and the front opening. The front opening is usually covered by a screen to prevent small animals or debris from entering the off-ridge roof ventilation device. Such off-ridge roof ventilation devices are disadvantageous in high wind situations, because rain and/or snow can pass through the front opening and reach the interior of the building through the opening in the roof deck.

Accordingly, there is an established need for an off-ridge roof ventilation device, which completely eliminates wind driven rain and/or snow even in high wind situations. The off-ridge roof ventilation device should preferably also be aerodynamic and prevent small animals and/or debris from entering the ventilation device without a need for a screen.

SUMMARY OF THE INVENTION

The present invention consists of an off-ridge roof ventilation device for placing on an opening of a roof deck, the off-ridge roof ventilation device comprising an outer hood having a perforated top face and a venting opening on a bottom face. The venting opening is intended to face an opening on a roof deck. A throat or water-retaining panel is arranged on the bottom face of the main hood in a manner to reduce the venting opening. A perforated interior panel is arranged between the top face of the main hood and the throat panel, and is configured to allow inside air venting while retaining outside rain and directing the rain towards the throat panel.

The interior panel along with the aerodynamic hood completely eliminates wind driven rain even in high wind situations. No front opening, no screen, and no exterior baffle are needed. The perforations on the lower portion of the hood allow the air to flow through the ventilation device. The ventilation device is maintenance free and totally resistant to wind uplift and wind driven rain. Without the need for having an open front as is typically known in the art, such a structure provides superior resistance to wind driven rain by not allowing wind to enter the ventilation device.

In a first implementation of the invention, the off-ridge roof ventilation device comprises a main hood configured to cover an opening on a roof deck. The main hood is provided with perforations and an open bottom. A throat panel is arranged on the open bottom of the main hood and is configured to partially cover the open bottom of the main hood leaving a venting opening in the open bottom of the main hood, the venting opening configured to be arranged over the opening on the roof deck. A perforated interior panel is arranged between the top face of the main hood and the throat panel.

In a second aspect, the throat panel can extend from a front edge of the main hood towards a rear edge of the main hood, and the venting opening of the main hood can extend from a rear edge of the throat panel to the rear edge of the main hood.

In another aspect, the throat panel can include an interior baffle configured to at least partially block outside air entering through the perforations of the main hood from flowing towards the venting opening of the main.

In another aspect, the interior baffle may extend from the rear edge of the throat panel.

In another aspect, a left side of the main hood may be closed by a left-side panel and a right side of the main hood may be closed by a right-side panel.

In another aspect, each one of the left-side panel and right-side panel can include a face portion and a side flange extending from the face portion.

In yet another aspect, the main hood may include a rear portion and a front portion. The front portion of the main hood can be a solid wall comprising the perforations of the main hood, and the rear portion of the main hood can be a non-perforated solid wall.

In another aspect, the rear portion may be convex and rearward-sloped and the front portion may be convex and frontward-sloped.

In another aspect, the rear portion of the main hood can be reinforced with at least one reinforcement rib.

In another aspect, the perforations in the main hood and/or the throat panel can be formed by a roll forming process.

In yet another aspect, the perforations in the main hood and/or the throat panel can be C-shaped and may include front and rear openings.

In another aspect, the perforations in the main hood and/or the throat panel can be formed as louvers.

In another aspect, the roof ventilation device can further include a front flange extending frontward from a front edge of the main hood, the front flange configured to rest on the roof deck.

In yet another aspect, the front flange can include an upward bent to increase rigidity of the front flange and roof ventilation device.

In another aspect, the roof ventilation device can include a rear flange extending rearward from a rear side of the main hood, the rear flange configured to rest on the roof deck.

In another aspect, the perforations of the interior panel can be shaped the same as the perforations of the main hood.

In another aspect, the perforations of the interior panel can be oriented towards the bottom side of the main hood.

In yet another aspect, the perforations of the main hood can be oriented outwardly of the main hood.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
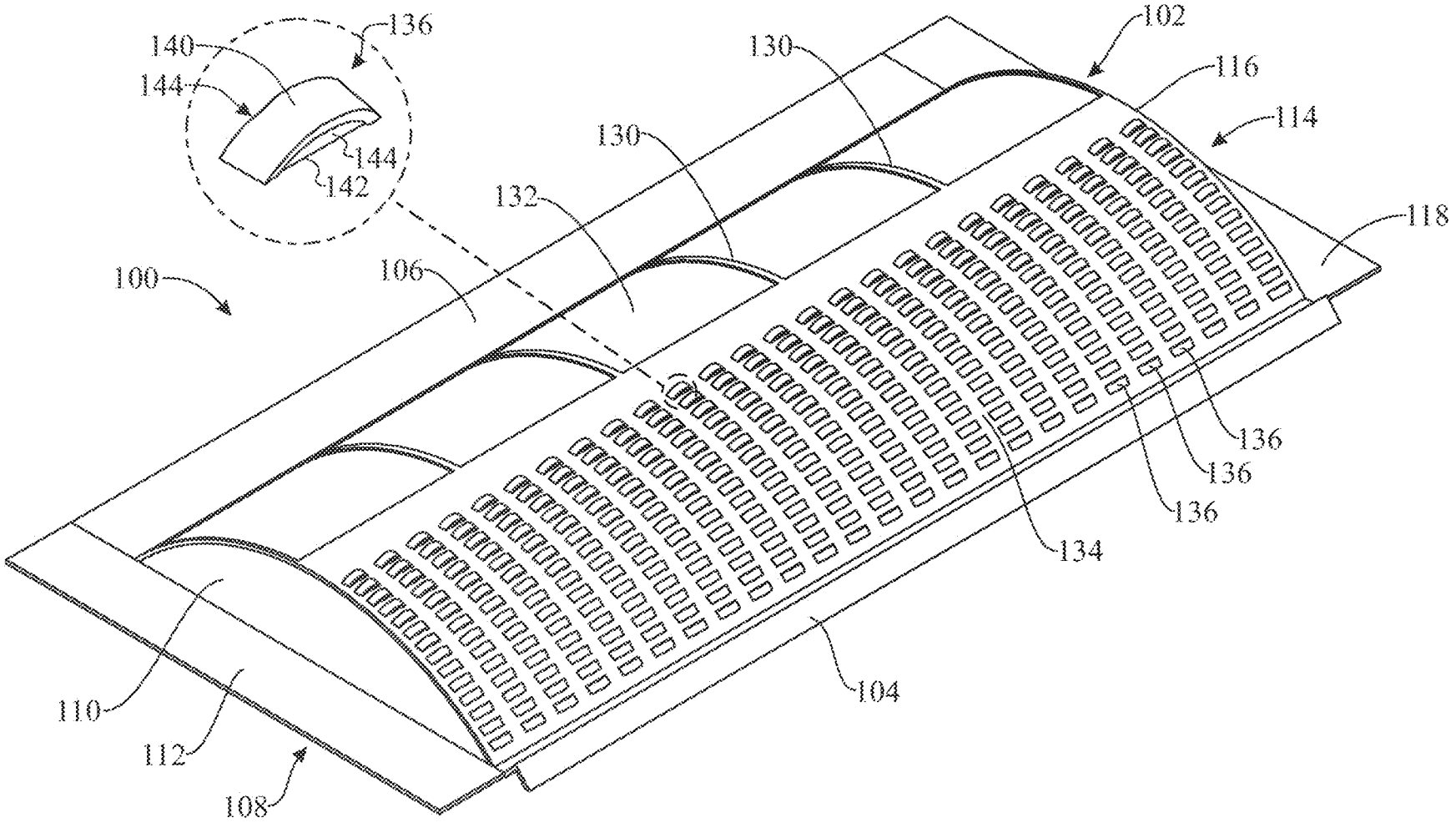
FIG. 1 presents a top front isometric view of an off-ridge roof ventilation device according to an embodiment of the present invention.

The illustration of FIG. 1 presents a top front isometric view of an off-ridge roof ventilation device 100 according to an embodiment of the present invention. The ventilation device 100 is designed for placing on an opening 420 of a roof deck 400 (FIGS. 5 and 6) and comprises a main hood 102. The main hood 102 comprises an elongated body with longitudinal, left and right ends and a curved top surface providing an aerodynamic profile, in a manner that the curved main hood 102 provides superior resistance to wind uplift. In some embodiments, such as the present embodiment, the main hood 102 is formed from a single sheet of metal.

The ventilation device 100 further comprises a front flange 104 extending from a front lateral side of the main hood 102, and a rear flange 106 extending from a rear lateral side of the main hood 102. In some embodiments, the front flange 104 can be designed as a stiffening rib or bend to increase rigidity. The ventilation device 100 further comprises a left-side panel 108 and a right-side panel 114. As shown in FIG. 1 and best shown in FIG. 3, the left side panel 108 is attached to the left end of the main hood 102 in a manner that a face portion 110 of the left side panel 108 closes the left end of the main hood 102; similarly, the right-side panel 114 is attached to the right end of the main hood 102 in a manner that a face portion 116 of the right-side panel 114 closes the right end of the main hood 102.

With continued reference to FIG. 1, the main hood 102 comprises a rear portion 132 and a front portion 134. The rear portion 132 is convex and rearward-sloped, while the front portion 134 is convex and frontward-sloped. The front portion 134 is designed as an integral perforated portion with a plurality or array of perforations 136. The perforations 136 in the front portion 134 can be formed, for instance and without limitation, by a roll forming process. Each perforation 136 is formed as a mini-louver and is dome-shaped or C-shaped, and comprises a curved bridge portion 140 extending over and spaced-apart from a perforation opening 142 and providing a small front opening 144 and a small rear opening 146.

As way of example, the openings of the perforations 136 of the front portion 134 of the hood 102 may have a size of 0.42 inches by 0.12 inches. This size leads to openings with 0.04 square inches. Therefore, the front portion 134 of the hood 102 allows a free air space of 0.04 square inches per opening. Thus, a four-foot ventilation device 100 with 3,026 perforations 136 may provide a total of 121 square inches of free air space.

As best shown in FIG. 1, the rear portion 132 of the main hood 102 is substantially solid and can be reinforced with reinforcement ribs 130. In some embodiments, the reinforcement ribs 130 can be spaced 12" apart from each other and run the entire height of the rear portion 132 of the main hood 102.

In some embodiments, the left-side panel 108 can be attached to the left end of the main hood 102 of the ventilation device 100 using a Pittsburgh seam. Similarly, the right-side panel 114 can be attached to the left end of the main hood 102 of the ventilation device 100 using a Pittsburgh seam. A ¼" side flange of the left- and right-side panel 108, 114 can be inserted into the pocket of the Pittsburgh seam. The pocket of the Pittsburgh seam may be filled with a non-hardening seam sealant. The filling of the sealant may be completed prior to the folding of the metal or material used for the main hood 102. The outer edge of the Pittsburgh seam may then be hammered over the left- and right-side panel 108, 114.

Figure 2:
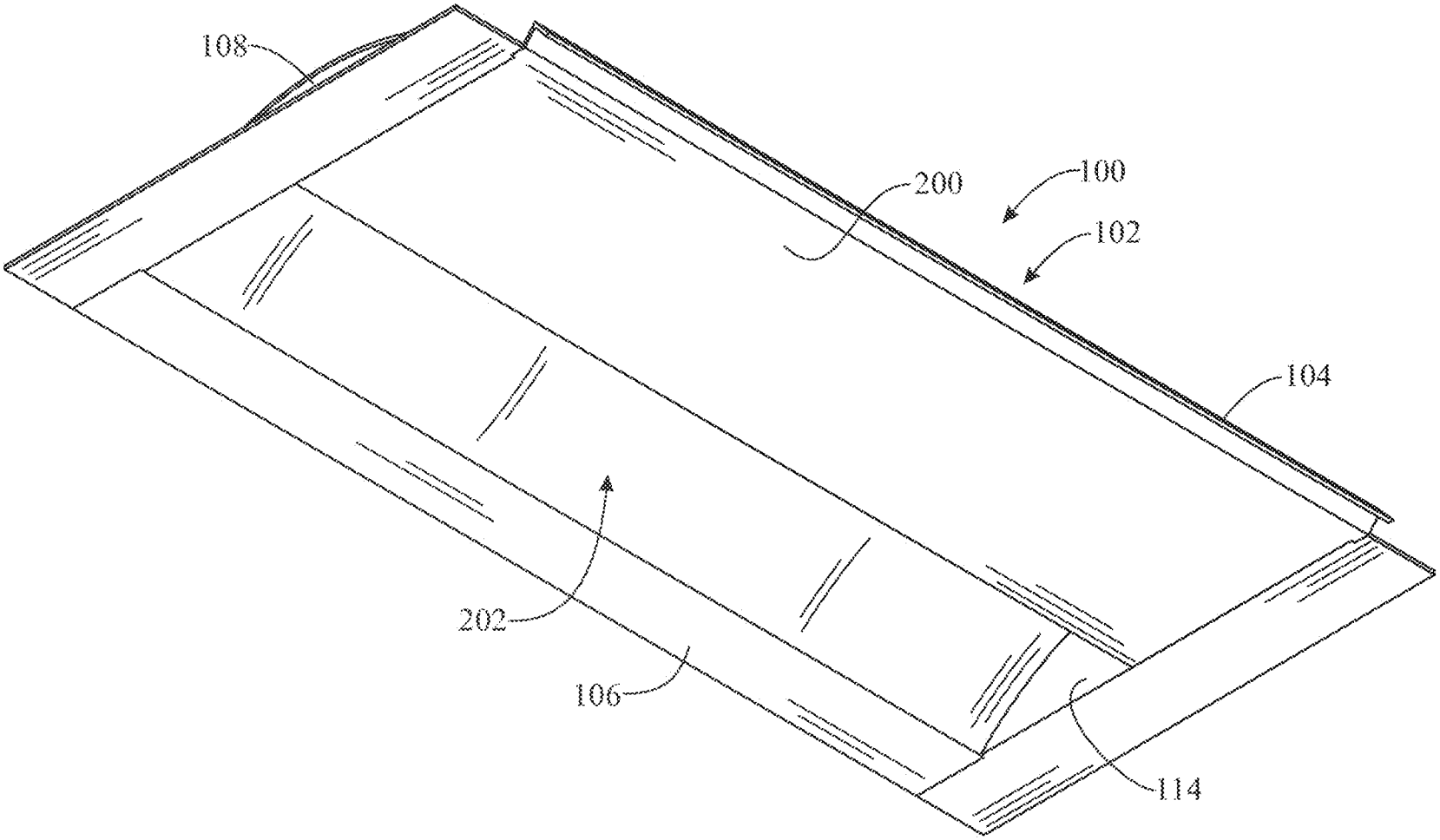
FIG. 2 presents a bottom front isometric view of the off-ridge roof ventilation device of FIG. 1.

The illustration of FIG. 2 presents a bottom front isometric view of the off-ridge roof ventilation device 100 of FIG. 1. According to this illustration, the ventilation device 100 of FIG. 1 also comprises a throat panel 200 and a venting opening 202 arranged on a bottom side of the ventilation device 100 and configured to face the roof opening for purposes that will be hereinafter described. As shown, the throat panel 200 is arranged frontward and parallel to the venting opening 202, and both the throat panel 200 and the venting opening 202 extend across the hood 202, from the left-side panel 108 to the right-side panel 114. The left- and right-side panels 108, 114 can be attached to the throat panel 200 by a clinch lock attachment, for instance and without limitation.

Figure 3:
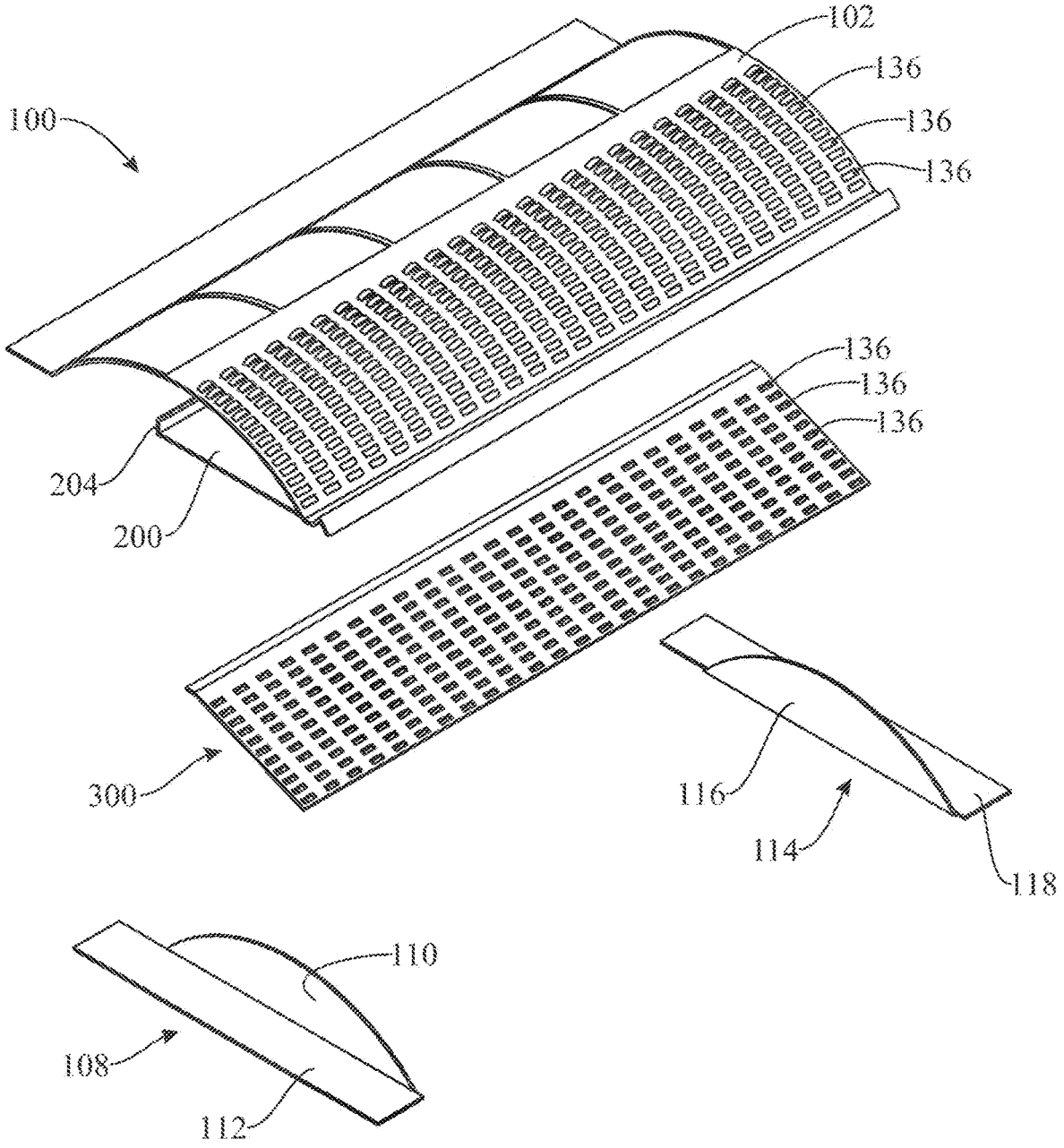
FIG. 3 presents an exploded top front view of the off-ridge roof ventilation device of FIG. 1.

The illustration of FIG. 3 presents an exploded top front view of the off-ridge roof ventilation device 100 of FIG. 1. As shown, the left-side panel 108 includes the aforementioned face portion 110 and a side flange 112 extending from the face portion 110 of the left-side panel 108. Furthermore, the right-side panel 114 includes the aforementioned face portion 116 and a side flange 118 extending from the face portion 116 of the right-side panel 114. The ventilation device I 00 further comprises an interior panel 300 with perforations 136. As better shown in FIGS. 5 and 6, the interior panel 300 is arranged beneath the hood 102, and more specifically, between the hood 102 and the throat panel 200 and preferably frontward-sloped. The perforations 136 of the interior panel 300 can have the same shape and size as the perforations 136 of the hood 102, with the bridge portions 140 of the perforations 136 of the interior panel 300 oriented downward instead of upward.

Figure 4:
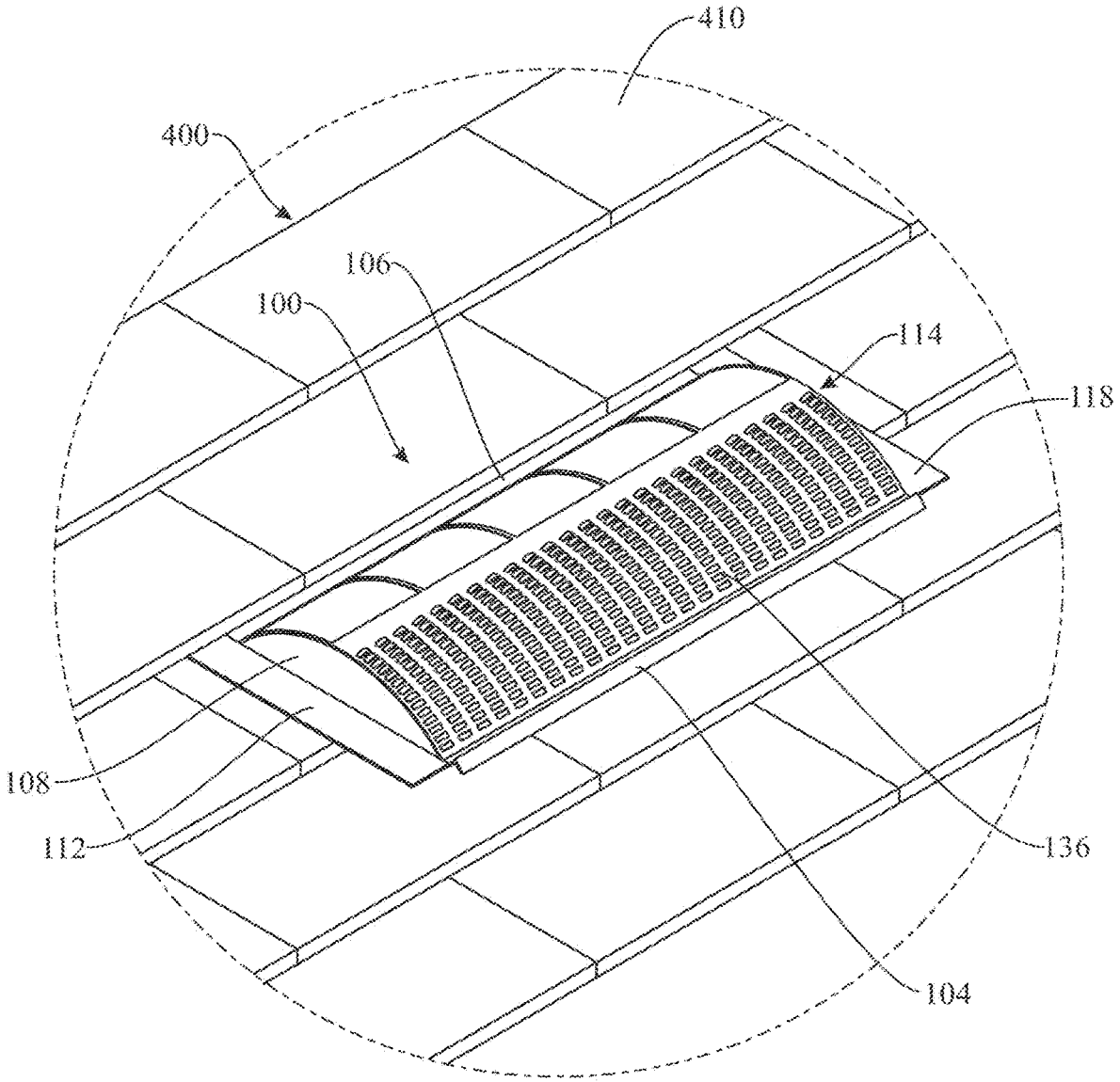
FIG. 4 presents a top front isometric view of the off-ridge roof ventilation device of FIG. 1 mounted on a roof deck according to an illustrative application of the present invention.

The illustration of FIG. 4 presents a top front isometric view of the off-ridge roof ventilation device 100 of FIG. 1 mounted on a roof deck 400 according to an illustrative application of the present invention. In the present illustrative application, the roof deck 400 is covered by shingles 410. The ventilation device 100 can be installed on the roof deck 400 such that the front and rear flanges 104, 106 extend substantially parallel to the ridge (not shown, but otherwise parallel to the roof shingles 410), with the rear flange 106 more proximate to the ridge than the front flange 104. The left- and right-side panels 108, 114 extend substantially perpendicular to the ridge.

Figure 5:
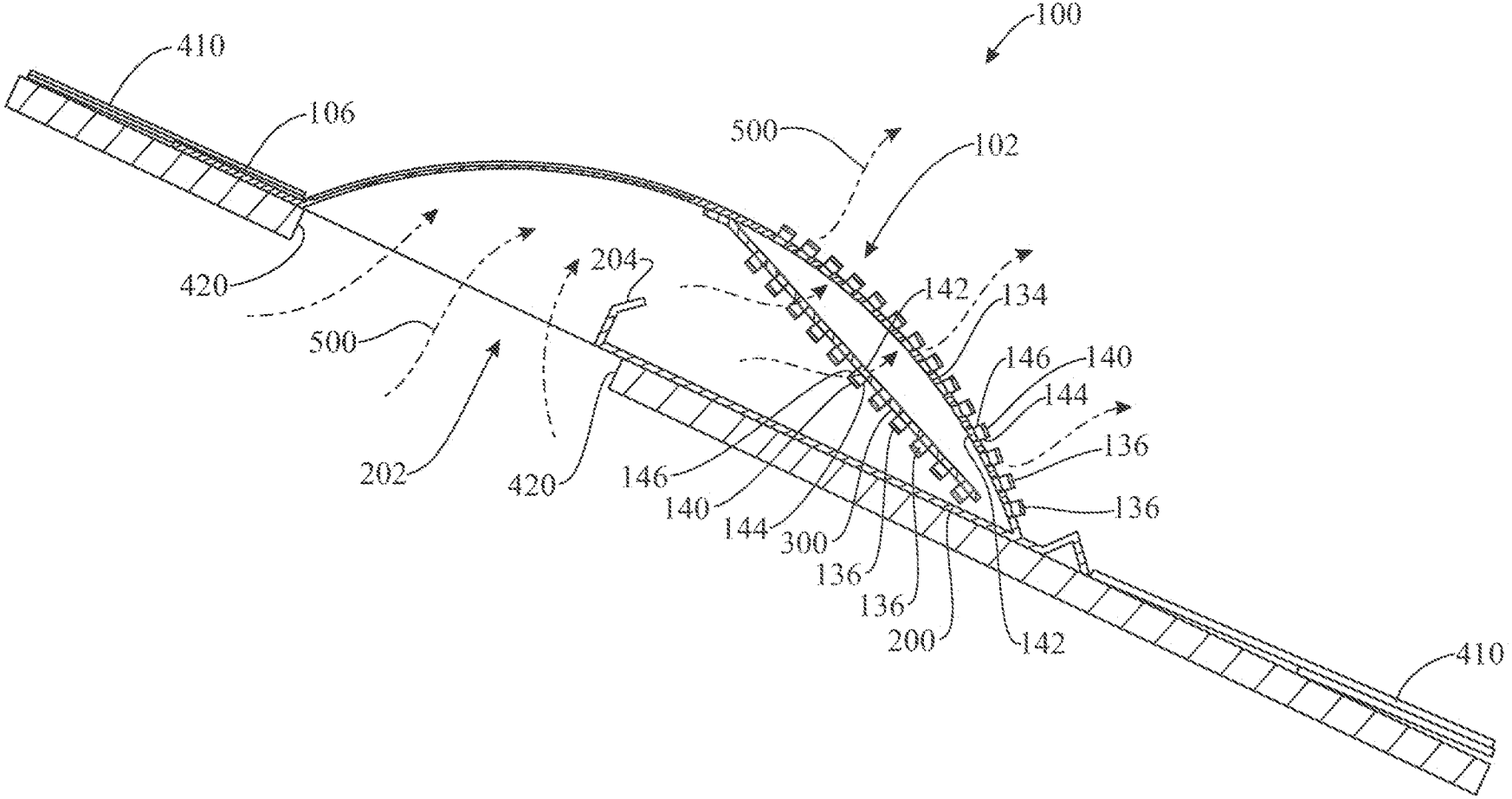
FIG. 5 presents a cross-sectional side elevation view of the off-ridge roof ventilation device and roof deck installation of FIG. 4, showing the off-ridge roof ventilation device venting air from inside roof.
Figure 6:
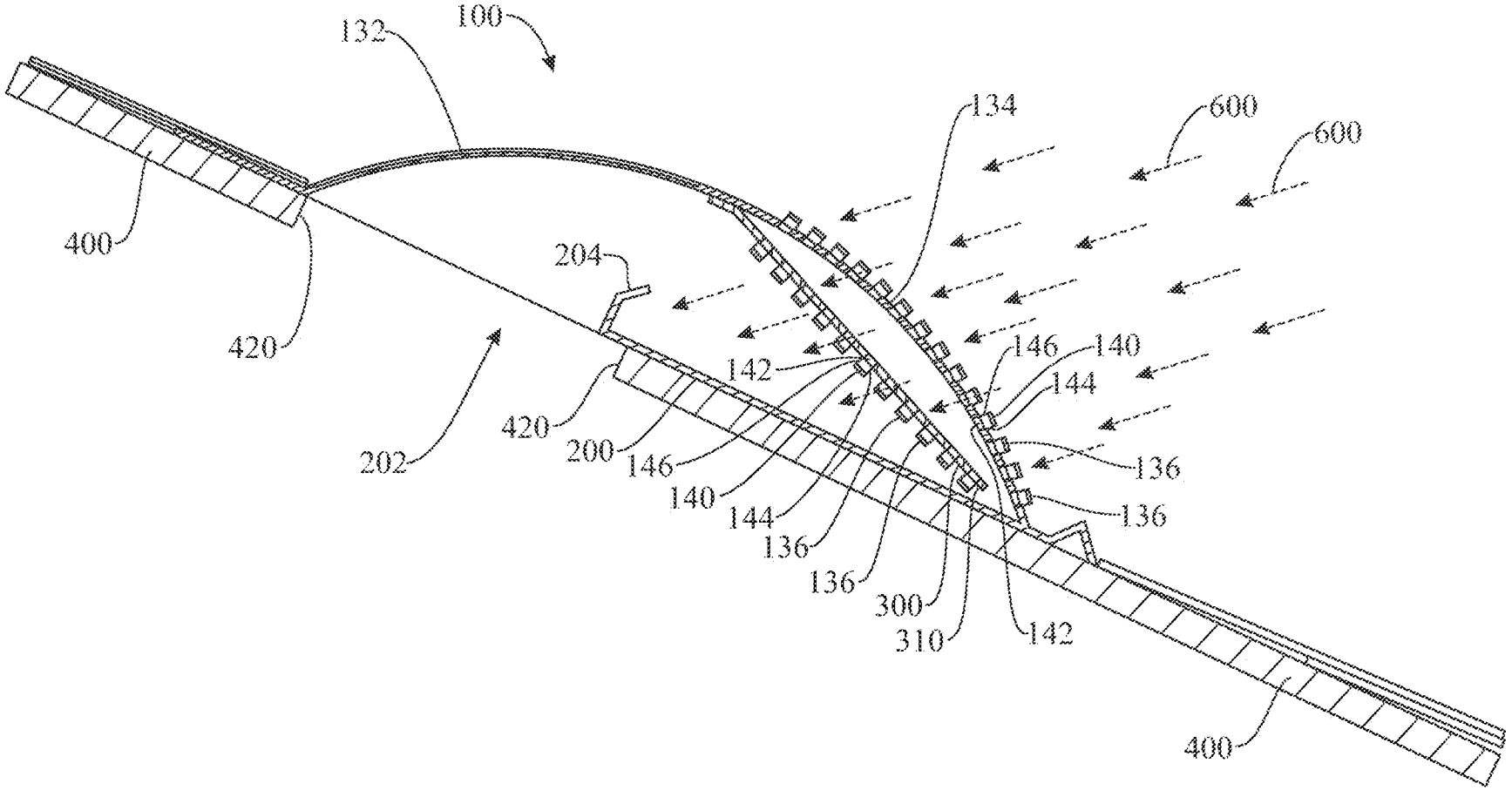
FIG. 6 presents a cross-sectional side elevation view of the off-ridge roof ventilation device and roof deck installation of FIG. 4, showing the off-ridge roof ventilation device stopping wind, rain and other external agents outside the roof from entering the roof.

As shown in FIG. 4 and also in FIGS. 5 and 6, the rear flange 106 can be covered by shingles 410 for a better attachment of the ventilation device 100 on the roof deck 400. In turn, the side flanges 112, 118 of the left- and right-side panels 108, 114 and the front flange 104 can be placed above or adjacent to the shingles 410, i.e. not covered by the shingles 410.

The side flanges 112, 118 of the left- and right-side panels 108, 114 and the main hood 102 provide a sealing of the opening of the roof deck 400 by the ventilation device 100 thereby contributing to comply with best roofing industry practices.

The illustration of FIG. 5 presents a cross-sectional side elevation view of the off-ridge roof ventilation device 100 and roof deck 400 installation of FIG. 4. According to this illustration, the ventilation device 100 is placed on the roof deck 400 and completely covers the opening 420 of the roof deck 400. The opening 420 of the roof deck 400 faces and is in fluid communication with the venting opening 202 of the ventilation device 100. An underside of the throat panel 200 touches the roof deck 400 close to the opening 420 of the roof deck 400 in a large area, giving the ventilation device 100 a strong attachment to the roof deck 400. The air is vented from an interior of a building through the off-ridge roof ventilation device 100, which provides a single piece hood that is aerodynamic in nature with no large openings on the outer surface of the ventilation device 100.

Additionally, as with reference to FIGS. 5 and 3, an interior ridge or baffle 204 can be attached to or extend from the throat panel 200 at its top or rear edge and extend inwardly into the hood 102, such as at a right angle with the throat panel 200. Preferably, the interior baffle 204 has a low profile or height to allow a relatively large air space between the interior baffle 204 and the hood 102. For example, in the depicted embodiment, a full 2.5 inches of free air space can be provided between the interior baffle 204 and the hood 102. With further reference to FIG. 5, venting air 500 flows from the inside of the building to the opening 420 of the roof deck 402 and from there to the venting opening 202 of the venting device 100. Once the air is inside the venting device 100, it is sucked out of the venting device 100 through the perforations 136 of the interior panel 300 and the perforations 136 of the front portion 134 of the main hood 102, and more specifically, through the perforation opening 142, front opening 144 and rear opening 146 of each perforation 136.

In some embodiments, as in the present embodiment, the interior panel 300 can comprise the same number of perforations 136 as on the front portion 134 of the hood 102. As mentioned heretofore, the perforations 136 of the interior panel 300 can be shaped the same as the perforations 136 of the front portion 134 of the main hood 102. However, the perforations 136 of the interior panel 300 can be oriented inwardly to the interior of the venting device 100. In contrast, the perforations 136 of the front portion 134 of the main hood 102 can be oriented outwardly of the interior of the venting device 100.

The illustration of FIG. 6 presents a cross-sectional side elevation view of the off- ridge roof ventilation device 100 and roof deck 400 installation of FIG. 4, in a situation in which outside wind 600 is impacting the installation. The wind 600 can be, for instance, a high-speed wind that strikes frontally on the front portion 134 of the ventilation device 100. The wind 600 can drive rain and/or snow to the front portion 134 of the ventilation device 100. In case the air, rain and/or snow is driven through the openings of the perforations 136 of the front portion 134 of the ventilation device 100, the rain and/or snow will fall on the interior panel 300.

The air, rain and/or snow is then further mitigated and/or retained by the interior panel 300; for example, the rain and/or snow flows along the upper, sloped surface of the interior panel 300 to a lower edge of the interior panel 300 and drops on throat panel 200 through a gap 310 which is formed between the lower edge of the interior panel 300 and the throat panel 200. From there the rain and/or snow can flow out of the ventilation device 100 through the first three rows of the perforations 136 of the front portion 134, and any remaining humidity inside the hood 102 can eventually evaporate. The baffle 204 at the top end of the throat panel 200 contributes to retain any air and/or water within the throat panel 200 and prevent it from passing through the venting opening 202 of the ventilation device 100 and the opening 420 of the roof deck 400.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An off-ridge roof ventilation device for placing on an opening of a roof deck, comprising:

a main hood configured to cover an opening on a roof deck, the main hood comprising perforations and an open bottom;

a throat panel arranged on the open bottom of the main hood and configured to partially cover the open bottom of the main hood leaving a venting opening in the open bottom of the main hood, the venting opening configured to be arranged over the opening on the roof deck; and an interior panel arranged between the main hood and the throat panel, the interior panel separate from the throat panel and comprising:

perforations extending therethrough;

a first end attached to and extending from the main hood; and a second end, spaced apart from the main hood and overlying the throat panel.

2. The roof ventilation device of claim 1, wherein the throat panel extends from a front edge of the main hood towards a rear edge of the main hood, and the venting opening of the main hood extends from a rear edge of the throat panel to the rear edge of the main hood.

3. The roof ventilation device of claim 2, wherein the throat panel comprises an interior baffle configured to at least partially block outside air entering through the perforations of the main hood from flowing towards the venting opening of the main hood.

4. The roof ventilation device of claim 3, wherein the interior baffle extends from the rear edge of the throat panel.

5. The roof ventilation device of claim 2, wherein a left side of the main hood is closed by a left-side panel and a right side of the main hood is closed by a right-side panel.

6. The roof ventilation device of claim 5, wherein each one of the left-side panel and right-side panel comprises a face portion and a side flange extending from the face portion.

7. The roof ventilation device of claim 1, wherein the main hood comprises a rear portion and a front portion, wherein the front portion of the main hood is a solid wall comprising the perforations of the main hood, and the rear portion of the main hood is a non-perforated solid wall.

8. The roof ventilation device of claim 7, wherein the rear portion is convex and rearward-sloped and the front portion is convex and frontward-sloped.

9. The roof ventilation device of claim 7, wherein the rear portion of the main hood is reinforced with at least one reinforcement rib.

10. The roof ventilation device of claim 1, wherein the perforations in at least one of the main hood and the throat panel are formed by a roll forming process.

11. The roof ventilation device of claim 1, wherein the perforations in at least one of the main hood and the throat panel are C-shaped and comprise front and rear openings.

12. The roof ventilation device of claim 1, wherein the perforations in at least one of the main hood and the throat panel are formed as louvers.

13. The roof ventilation device of claim 1, further comprising a front flange extending frontward from a front edge of the main hood, the front flange configured to rest on the roof deck.

14. The roof ventilation device of claim 13, wherein the front flange comprises an upward bend.

15. The roof ventilation device of claim 1, further comprising a rear flange extending rearward from a rear side of the main hood, the rear flange configured to rest on the roof deck.

16. The roof ventilation device of claim 1, wherein the perforations of the interior panel are shaped the same as the perforations of the main hood.

17. The roof ventilation device of claim 1, wherein the perforations of the interior panel are formed as louvers oriented towards the open bottom of the main hood.

18. The roof ventilation device of claim 1, wherein the perforations of the main hood are formed as louvers oriented outwardly of the main hood.

19. An off-ridge roof ventilation device for placing on an opening of a roof deck, comprising:

a main hood configured to cover an opening on a roof deck, the main hood comprising perforations and an open bottom, wherein a left side of the main hood is closed by a left-side panel and a right side of the main hood is closed by a right-side panel;

a throat panel arranged on the open bottom of the main hood and extending from a front edge of the main hood towards a rear edge of the main hood, wherein the throat panel is configured to partially cover the open bottom of the main hood leaving a venting opening in the open bottom of the main hood, wherein the venting opening extends from a rear edge of the throat panel to the rear edge of the main hood and is configured to be arranged over the opening on the roof deck; and an interior panel arranged between the main hood and the throat panel, the interior panel separate from the throat panel and comprising:

perforations extending therethrough;

a first end attached to and extending from the main hood; and a second end, spaced apart from the main hood and overlying the throat panel.

20. An off-ridge roof ventilation device for placing on an opening of a roof deck, comprising:

a main hood configured to cover an opening on a roof deck, the main hood comprising a rear portion and a front portion, wherein the front portion of the main hood is a convex, frontward-sloped solid wall provided with perforations, and the rear portion is a convex, rearward-sloped non-perforated solid wall, wherein a left side of the main hood is closed by a left-side panel and a right side of the main hood is closed by a right-side panel;

a throat panel arranged on the open bottom of the main hood and extending from a front edge of the main hood towards a rear edge of the main hood, wherein the throat panel is configured to partially cover the open bottom of the main hood leaving a venting opening in the open bottom of the main hood, wherein the venting opening extends from a rear edge of the throat panel to the rear edge of the main hood and is configured to be arranged over the opening on the roof deck; and an interior panel arranged between the main hood and the throat panel, the interior panel separate from the throat panel and comprising:

perforations extending therethrough;

a first end attached to and extending from the main hood; and a second end, spaced apart from the main hood and overlying the throat panel;

wherein the perforations in the main hood and the throat panel are formed as louvers.

* * * * *